US007289135B2

(12) United States Patent
Oku

(10) Patent No.: US 7,289,135 B2
(45) Date of Patent: Oct. 30, 2007

(54) COLOR IMAGE-FORMING APPARATUS CONTROLLING TIMING OF COLOR PATTERN FORMATION

(75) Inventor: Juntaro Oku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 11/147,004

(22) Filed: Jun. 7, 2005

(65) Prior Publication Data

US 2005/0275707 A1 Dec. 15, 2005

(30) Foreign Application Priority Data

Jun. 9, 2004 (JP) ..... 2004-171738

(51) Int. Cl.
*B41J 2/435* (2006.01)

(52) U.S. Cl. ..... 347/234; 347/248

(58) Field of Classification Search ..... 347/116, 347/232, 240, 248–254, 234–235; 399/49, 399/110, 228; 358/1.4, 448
See application file for complete search history.

(56) References Cited

U.S. PATENT DOCUMENTS 5,915,074 A * 6/1999 Shimazawa et al. ..... 358/1.4
5,991,051 A * 11/1999 Tamagaki ..... 358/448
6,292,641 B1 * 9/2001 Takeyama et al. ..... 399/228
6,674,982 B2 * 1/2004 Saitoh et al. ..... 399/110
6,718,151 B2 * 4/2004 Kibune et al. ..... 399/228
7,181,148 B2 * 2/2007 Sakai et al. ..... 399/49
2004/0100550 A1 * 5/2004 Bannai et al. ..... 347/232
2005/0212887 A1 * 9/2005 Tanaka et al. ..... 347/116

FOREIGN PATENT DOCUMENTS

JP 09030053 A * 2/1997

* cited by examiner

*Primary Examiner*—Hai Pham
(74) *Attorney, Agent, or Firm*—Canon U.S.A. Inc I.P. Div

(57) ABSTRACT

A color image-forming apparatus including two drums, two scanners for forming latent images on the two drums, four developing devices for developing the latent images on the drums into toner images with four colors, an intermediate transfer belt successively passing the drums so that the toner images are successively transferred onto the belt, a transfer unit for transferring the toner image on the belt onto a recording medium, and a control unit controlling the two scanners to form patterns of first, second, third, and fourth colors and controlling timing at which the two scanners write on the drums such that the patterns approach one another.

5 Claims, 9 Drawing Sheets

COLOR IMAGE-FORMING APPARATUS CONTROLLING TIMING OF COLOR PATTERN FORMATION

BACKGROUND OF THE INVENTION

1. Field of the Invention

The present invention relates to image-forming apparatuses, such as color printers and color copy machines.

2. Description of the Related Art

Electrophotographic color image-forming apparatuses having various structures are known. For example, a so-called single path structure includes four photosensitive drums, four optical units, yellow (hereinafter Y), magenta (hereinafter M), cyan (hereinafter C), and black (hereinafter K) developing devices, and a single conveyor belt. In this structure, each of the Y, M, C, and K developing devices has a dedicated photosensitive drum and an optical unit, and a sheet of paper held by the conveyor belt successively passes the Y, M, C, and K photosensitive drums, where Y, M, C, and K images are transferred onto the sheet of paper. In this structure, processes of forming the Y, M, C, and K images are performed in parallel, and therefore the process speed can be increased. However, since four photosensitive drums and four optical units like laser scanners are necessary, it is difficult to reduce the size of the apparatus. In addition, since the images of different colors are formed at different positions until they are transferred onto the sheet, it is difficult to reduce color shifts.

On the other hand, a so-called four path structure includes a single photosensitive drum, a single optical unit, Y, M, C, and K developing devices, and a single intermediate transfer member. In this structure, the Y, M, C, and K developing devices successively come into contact with the photosensitive drum and transfer toner images of respective colors onto the intermediate transfer member. Accordingly, images of four colors are superimposed on the intermediate transfer member, and are then simultaneously transferred onto a sheet of paper. Since only one photosensitive drum and one optical unit like a laser scanner are necessary, the size of the apparatus can be reduced. In addition, since the images of four colors are formed at the same position on the photosensitive drum and the intermediate transfer member, color shifts do not easily occur. However, since a similar process is repeated four times, it is difficult to increase the print speed.

Accordingly, a two-path structure including two photosensitive drums, two optical units, Y, M, C, and K developing devices, and a single intermediate transfer member is known as an intermediate structure of the above-described structures. In this structure, for example, developing devices for Y (first color) and C (second color) are disposed around one of the photosensitive drums, and developing devices for M (third color) and K (fourth color) are disposed around the other one of the photosensitive drums. During a first turn of the intermediate transfer member, the Y and M developing devices are brought into contact with the respective photosensitive drums to transfer Y and M toner images onto the intermediate transfer member. During a second turn of the intermediate transfer member, the C and K developing devices are brought into contact with the respective photosensitive drums to transfer C and K toner images onto the intermediate transfer member such that the C and K toner images are superimposed on the images of Y and M. Then, all of the toner images are simultaneously transferred onto a sheet of paper. This structure has intermediate characteristics between those of the single-path and four-path structures.

Various methods are suggested for setting timing to start writing images of different colors in electrophotographic printers having the two-path structure. Here, it is assumed that Y and M images are formed by upstream and downstream image-forming units, respectively, during the first turn of the intermediate transfer member and C and K images are formed by the upstream and downstream image-forming units, respectively, during the second turn of the intermediate transfer member. Accordingly, the Y, M, C, and K images are formed in that order.

FIG. 9 is a diagram showing a known two-path structure. The two-path structure includes upstream and downstream photosensitive drums 1*a* and 1*b* and an intermediate transfer belt 4. An optical sensor 50 including a light emitter section and a light receiver section is provided for detecting horizontal lines on the intermediate transfer belt 4. The optical sensor 50 is disposed between an upstream image-forming unit and a downstream image-forming unit. FIG. 10 is a diagram showing a detection pattern on the intermediate transfer belt 4 of the known structure. Before an image-forming process is started, the photosensitive drums 1*a* and 1*b* are simultaneously subjected to exposure to form a detection pattern including a Y horizontal line 51 and an M horizontal line 52 on the intermediate transfer belt 4. FIG. 11 is a diagram showing detection timing of the detection pattern on the intermediate transfer belt 4 of the known structure. When the intermediate transfer belt 4 moves, first, the optical sensor 50 detects the Y horizontal line 51 (denoted by 53 in FIG. 11). Then, by the time the intermediate transfer belt 4 rotates by substantially one turn, the M horizontal line is detected (denoted by 54 in FIG. 11) and the Y horizontal line is detected for the second time (denoted by 55 in FIG. 11). Then, the detection pattern on the intermediate transfer belt 4 is cleaned. Since the exposure of the Y horizontal line 51 and the exposure of the M horizontal line 52 are performed at the same time, a gap between the Y and M horizontal lines 51 and 52 corresponds to a distance between the upstream and downstream image-forming units. The time to start writing in the downstream image-forming unit with respect to that in the upstream image-forming unit, that is, the time to form the M image with respect to the Y image or the time to form the K image with respect to the C image is determined on the basis of an interval (denoted by ta in FIG. 11) between the time at which the M horizontal line is detected (denoted by 54 in FIG. 11) and the time at which the Y horizontal line is detected the second time (denoted by 55 in FIG. 11). An interval between the time at which the Y horizontal line is detected the first time (denoted by 53 in FIG. 11) and the time at which Y horizontal line is detected the second time (denoted by 55 in FIG. 11) corresponds to the peripheral length of the intermediate transfer belt 4. Accordingly, the time to start writing in the upstream image-forming unit in the second turn with respect to that in the first turn, that is, the time to form the C image with respect to the Y image is determined on the basis of the interval (denoted by tb in FIG. 11) between the time at which the Y horizontal line is detected the first time (denoted by 53 in FIG. 11) and the time at which the Y horizontal line is detected the second time (denoted by 55 in FIG. 11). The time to start forming the Y image is determined on the basis of the time at which a sheet of paper is conveyed and the positional relationship between the toner image on the intermediate transfer belt 4 and a transfer area of the sheet of paper in which the toner image is transferred.

However, the above-described known structure has the following problems. That is, the color shifts cause a problem (becomes noticeable or apparent) even when they are very small relative to the gap between the upstream and downstream image-forming units and the peripheral length of the intermediate transfer belt. In general, the gap between the upstream and downstream image-forming units and the peripheral length of the intermediate transfer belt are about several tens to several hundreds of millimeters, while even a color shift about 150 μm or less causes a problem. Therefore, it is difficult to detect errors in time intervals corresponding to about 150 μm or less with high accuracy from detection results of time intervals corresponding to the movement of the intermediate transfer belt of about several tens to several hundreds of millimeters. In addition, the behavior of the intermediate transfer belt in the detecting section and the behavior of the intermediate transfer belt in the image-forming units are not always the same. Therefore, the time interval corresponding to the gap between the upstream and downstream image-forming units detected by the detecting unit from the movement of the intermediate transfer belt is different from the actual time which elapses while the intermediate transfer belt moves between the upstream and downstream image-forming units. Similarly, the time interval corresponding to the peripheral length of the intermediate transfer belt detected by the detecting unit from the movement of the intermediate transfer belt is different from the actual time interval between the times at which the intermediate transfer belt passes through the upstream image-forming unit in the first and second turns. Therefore, it is difficult to detect the color shifts between different colors with high accuracy by the known method.

FIG. 12 is a diagram showing an example of a color shift. The arrow shows a conveying direction of the intermediate transfer belt, and reference numerals 56 and 57 denote horizontal lines of different colors. These horizontal lines are normally formed at the same position in the conveying direction of the intermediate transfer belt. The color shift shown in FIG. 12 occurs when image-forming timing in the downstream image-forming unit with respect to that in the upstream image-forming unit is not accurately controlled or when image-forming timing in the second turn of the intermediate transfer belt with respect to that in the first turn is not accurately controlled.

SUMMARY OF THE INVENTION

The present invention is directed to an image-forming apparatus, such as an electrophotographic printer, having a two-path structure which accurately controls timing to start writing images of different colors, thereby reducing color shifts between upstream and downstream image-forming units and between first and second turns of an intermediate transfer belt.

According to one aspect of the present invention, a color image-forming apparatus includes first and second latent-image forming media; first and second writing units configured to form latent images on the first and second latent-image forming media, respectively, by exposure; first and second developing devices suitable for developing latent images on the first and second latent-image forming media into toner images with first and second colors, respectively; third and fourth developing devices suitable for developing latent images on the first and second latent-image forming media into toner images with third and fourth colors, respectively; an intermediate transfer device suitable for successively passing by the first and second latent-image forming media so that toner images developed on the first and second latent-image forming media are successively transferred onto the intermediate transfer device; a transfer unit which transfers a multi-color toner image on the intermediate transfer device onto a recording medium; and a control unit which controls the first and second writing units to form patterns of first, second, third, and fourth colors and controls timing at which the first and second writing units write on the first and second latent-image forming media, respectively, such that the patterns approach one another.

According to the present invention, timing to write images of different colors is adequately controlled on the basis of color-shift detection patterns including toner images of different colors which are arranged near each other. Accordingly, color shifts between toner images transferred onto the intermediate transfer device are effectively reduced.

In addition, according to the present invention, a color-shift detecting unit may be omitted. Accordingly, color-shift reduction can be provided at low cost.

In addition, according to the present invention, it is not necessary to perform a long-term management corresponding to one turn of the intermediate transfer device, and color shifts can be reduced with high accuracy.

Further features and advantages of the present invention will become apparent from the following description of exemplary embodiments with reference to the attached drawings.

DESCRIPTION OF THE EMBODIMENTS

Embodiments of the present invention will be described in detail below with reference to the accompanying drawings.

First Embodiment

Figure 1:
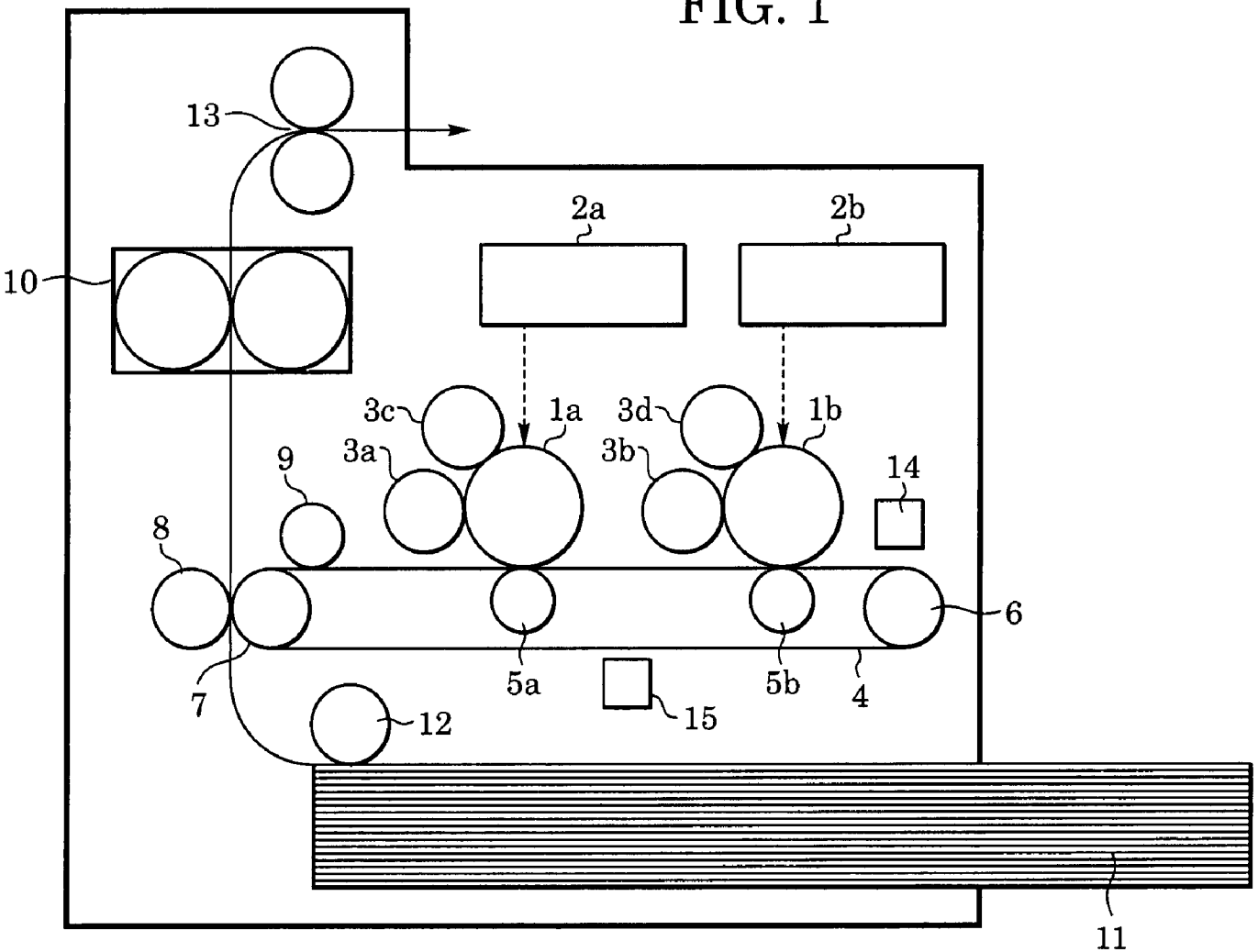
FIG. 1 is a diagram showing the overall structure of an image-forming apparatus according to embodiments of the present invention.

FIG. 1 is a schematic diagram of an image-forming apparatus (printer) according to a first embodiment of the present invention (apparatuses of other embodiments also have a similar structure). In the present embodiment, a color image-forming apparatus has a so-called two-path structure and includes two photosensitive drums, two optical units, yellow (hereinafter Y), magenta (hereinafter M), cyan (hereinafter C), and black (hereinafter K) developing devices, and a single intermediate transfer belt. In FIG. 1, electrostatic latent images are formed on photosensitive drums 1 (photosensitive drums 1*a* and 1*b* of first and second image-forming units, respectively). Laser scanners 2 (laser scanners 2*a* and 2*b* of the first and second image-forming units, respectively) form the electrostatic latent images on the photosensitive drums 1 by exposure based on image signals. Developing devices 3 (Y, M, C, and K developing devices 3*a*, 3*b*, 3*c*, and 3*d*) are arranged around the photosensitive drums 1. The developing devices 3 develop the electrostatic latent images on the photosensitive drums 1 to obtain toner images, and the toner images are successively transferred onto and conveyed by an intermediate transfer belt 4. More specifically, primary transfer rollers 5 (primary transfer rollers 5*a* and 5*b* of the first and second image-forming units, respectively) transfer the toner images onto the intermediate transfer belt 4. A belt-driving roller 6 drives the intermediate transfer belt 4, and a belt-driven roller 7 rotates when the intermediate transfer belt 4 moves and applies a predetermined tension to the intermediate transfer belt 4. Y, M, C, and K toner images are transferred onto the intermediate transfer belt 4 by the primary transfer rollers 5, and a secondary transfer roller 8 simultaneously transfers the Y, M, C, and K toner images onto a sheet of paper. A cleaning roller 9 collects toner remaining on the intermediate transfer belt 4 after the toner images are transferred onto the sheet of paper by the secondary transfer roller 8. A fixing device 10 melts and fixes the toner images transferred onto the sheet of paper by the secondary transfer roller 8, and a pickup roller 12 successively picks up sheets of paper placed in a paper cassette 11. Output rollers 13 output the sheet of paper on which the toner images are fixed by the fixing device 10. An optical sensor 14 is disposed downstream of the second image-forming unit in the conveying direction of the intermediate transfer belt 4 at a central position of the intermediate transfer belt 4 in the width direction thereof. The optical sensor 14 includes a light emitter section and a light receiver section for detecting color-shift detection patterns formed on the intermediate transfer belt 4.

Each of the developing devices 3 includes a contact/separate mechanism (not shown) with respect to the corresponding photosensitive drum 1, and the secondary transfer roller 8 and the cleaning roller 9 include contact/separate mechanisms (not shown) with respect to the intermediate transfer belt 4. The peripheral length of the intermediate transfer belt 4 is set longer than the maximum length of sheets of paper which can be set in the paper cassette 11. The component denoted by 15 is not used in first and second embodiments, and this component will be described in a third embodiment.

Figure 2:
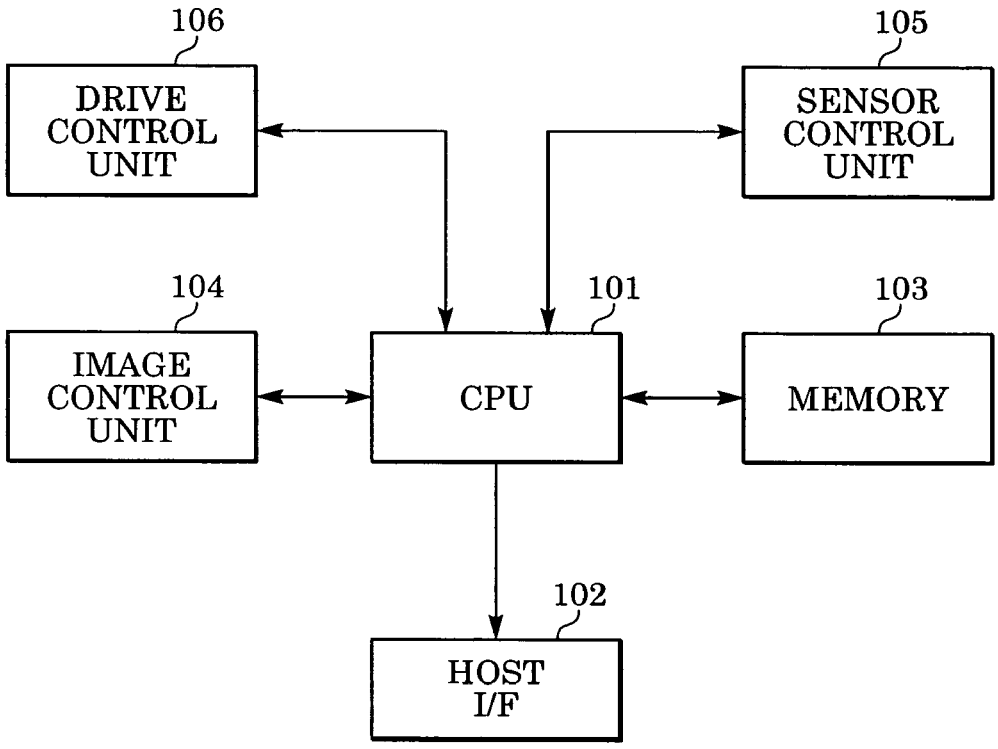
FIG. 2 is a diagram showing the overall structure of a control unit according to the embodiments of the present invention.

FIG. 2 is a diagram showing the overall structure of a control unit according to the embodiments of the present invention. A CPU 101 performs control management of the overall apparatus. A host I/F 102 provides communication between the printer and an external device, such as a personal computer (PC) which outputs print data. A memory 103 memorizes various information including print data and parameters, stores programs for causing the CPU 101 to perform the control management operation, and provides a work area for the CPU 101. As described in detail below, the CPU 101 provides a control component and a correcting component by operating in accordance with the programs stored in the memory 103. The control component controls timing at which laser scanners, which function as a writing component, write latent images corresponding to image data on the photosensitive drums 1, which function as latent-image forming media. In addition, the correcting component corrects the timing at which the laser scanners write the latent images on the basis of the amounts of shift in the color-shift detection patterns formed on the intermediate transfer belt 4, which functions as intermediate transfer component.

An image control unit 104 converts print data transmitted to the printer from the PC into data compatible with a printer engine. A sensor control unit 105 detects conditions of each part in the printer. A drive control unit 106 performs drive control of actuators in the printer engine, lasers, a high-voltage power source, etc.

When the print data is transmitted from the PC to the printer via the host I/F 102, the image control unit 104 performs data conversion into data compatible with the printer engine. The converted data is stored in the memory 103, and accordingly the printer is set to a printable state. Then, the drive control unit 106 starts driving the photosensitive drums 1, the intermediate transfer belt 4, the fixing device 10, etc., which are connected to a driving component including motors and gears. At this time, the secondary transfer roller 8 and the cleaning roller 9 are separated from the intermediate transfer belt 4. In the image-forming process during the first turn of the intermediate transfer belt 4, the developing devices 3*a* (Y) and 3*b* (M) come into contact with the photosensitive drums 1*a* and 1*b*, respectively. Y and M image signals are transmitted to the laser scanners 2*a* and 2*b*, respectively, at suitable timing and corresponding electrostatic latent images are formed on the photosensitive drums 1*a* and 1*b*. Then, the electrostatic latent images are developed as Y and M toner images by the developing devices 3*a* and 3*b*, respectively, and the Y and M toner images are transferred onto the intermediate transfer belt 4 by the primary transfer rollers 5. The M toner image is superimposed on the Y toner image. Then, in the image-forming process during the second turn of the intermediate transfer belt 4, the developing devices 3*a* (Y) and 3*b* (M) move away from the photosensitive drums 1*a* and 1*b*, respectively, and the developing devices 3*c* (C) and 3*d* (K) come into contact with the photosensitive drums 1*a* and 1*b*, respectively. C and K image signals are transmitted to the laser scanners 2*a* and 2*b*, respectively, at suitable timing and corresponding electrostatic latent images are formed on the photosensitive drums 1*a* and 1*b*. Then, the electrostatic latent images are developed as C and K toner images by the developing devices 3*c* and 3*d*, respectively, and the C and K toner images are transferred onto the intermediate transfer belt 4 by the primary transfer rollers 5. The C and K toner images are superimposed on the Y and M toner images. In the image-forming process during the second turn, the secondary transfer roller 8 and the cleaning roller 9 come into contact with the intermediate transfer belt 4 at timing corresponding to the position of the images on the intermediate transfer belt 4, and accordingly the toner images are transferred onto the piece of paper conveyed to the secondary transfer roller 8 from the paper cassette 11. Then, the fixing device 10 fixes the toner images on the sheet of paper by applying heat, and the sheet of paper is output by the output rollers 13. The toner remaining on the intermediate transfer belt 4 after the secondary transfer process is collected by the cleaning roller 9. The secondary transfer roller 8 and the cleaning roller 9 move away from the intermediate transfer belt 4 after the secondary transfer process and the toner collecting process. The inner state of the apparatus is monitored by the sensor control unit 105, and the CPU 101 controls the overall operation of the apparatus.

Figure 3:
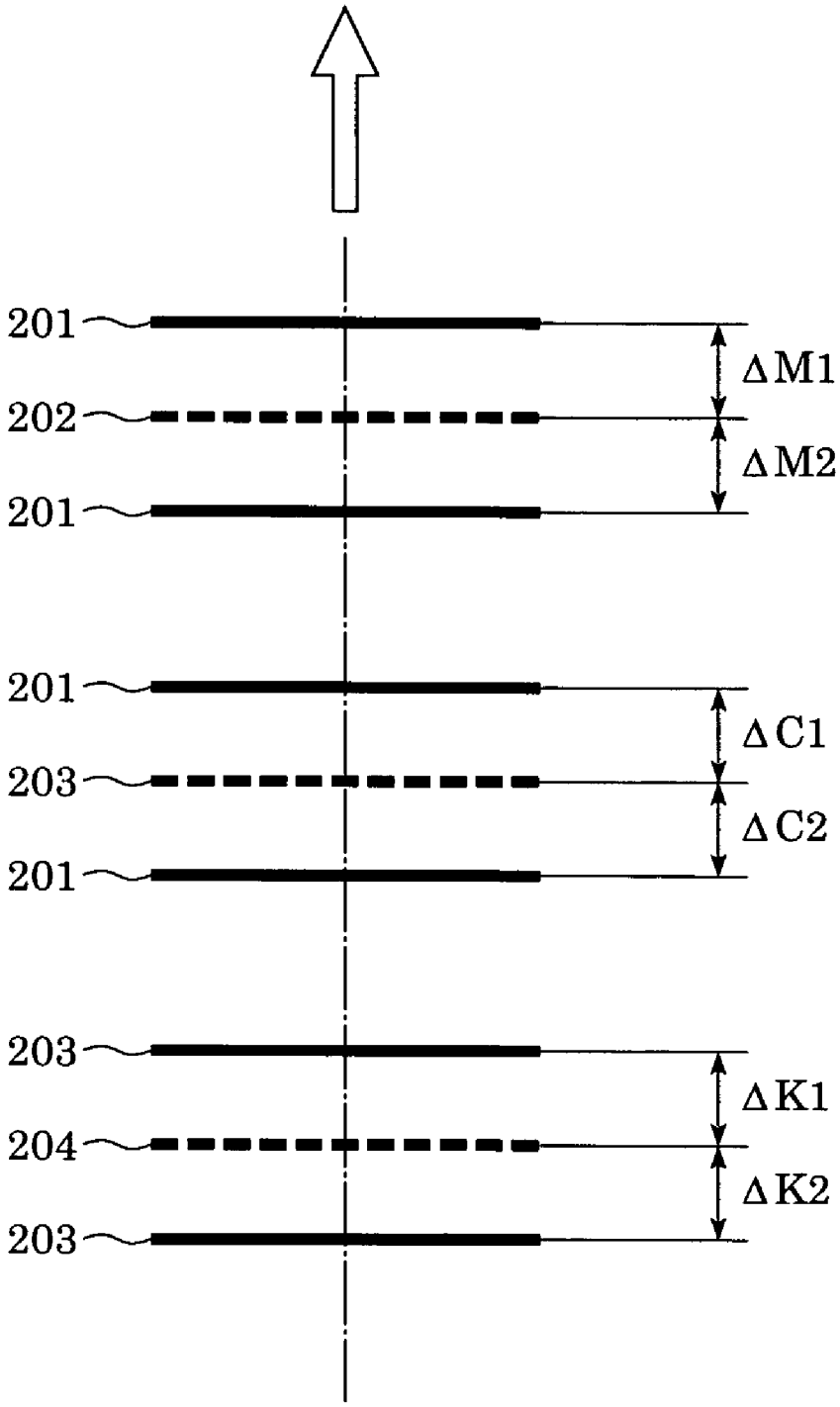
FIG. 3 is a diagram showing color-shift detection patterns according to a first embodiment of the present invention.

Next, the operation according to the present embodiment will be described below. FIG. 3 is a diagram showing color-shift detection patterns according to the present embodiment. The arrow shows a conveying direction of the intermediate transfer belt 4, and the one-dot chain line shows the position of the optical sensor 14, which detects the color-shift detection patterns, in a scanning direction (direction perpendicular to the conveying direction). Horizontal lines 201 are colored Y, which is the upstream color in the first turn of the intermediate transfer belt 4, and a horizontal line 202 is colored M, which is the downstream color in the first turn of the intermediate transfer belt 4. Horizontal lines 203 are colored C, which is the upstream color in the second turn of the intermediate transfer belt 4, and a horizontal line 204 is colored K, which is the downstream color in the second turn of the intermediate transfer belt 4. Processes of forming and detecting the color-shift detection patterns and correcting the timing to start writing images of different colors on the basis of the detected color shifts are performed at suitable timing for the printer, so that the color shifts do not increase. For example, the processes are performed when the power is turned on, when the photosensitive drums 1 and the developing devices 3 are replaced, when a predetermined number of sheets of paper are processed, etc. In the first turn of the intermediate transfer belt 4, Y is set as a reference color and a color-shift detection pattern having Y, M, and Y horizontal lines, in that order, is formed. A theoretical value of the gaps between Y and M horizontal lines is set to, for example, about 2 mm so that the horizontal lines do not overlap one another even if the color shifts are large. The theoretical value corresponds to timing at which latent images are formed on the photosensitive drums, the timing being calculated by the CPU 101 on the basis of the peripheral speed of the photosensitive drums (moving speed of the intermediate transfer belt).

The color-shift detection pattern of Y and M is formed in the first turn of the intermediate transfer belt, and then a color-shift detection pattern of Y and C and a color-shift detection pattern of C and K are formed in the second turn of the intermediate transfer belt similarly to the color-shift detection pattern of Y and M formed in the first turn. In the color-shift detection pattern of Y and C, Y, which corresponds to the first turn, is set as a reference color. In addition, in the color-shift detection pattern of C and K, C, which is the upstream color, is set as a reference color. After all of the color-shift detection patterns are formed in the second turn, the optical sensor 14 detects each of the color-shift detection patterns. In FIG. 3, ΔM1, ΔM2, ΔC1, ΔC2, ΔK1, and ΔK2 show detection time intervals between the lines in the color-shift detection patterns. By using Y or C as a reference, the M, C, and K color shifts are determined as follows:

$$M \text{ Color Shift}=(\Delta M1-\Delta M2)/2 \quad (1)$$

$$C \text{ Color Shift}=(\Delta C1-\Delta C2)/2 \quad (2)$$

$$K \text{ Color Shift}=(\Delta K1-\Delta K2)/2 \quad (3)$$

The timing to start writing images of different colors is corrected on the basis of the color shifts calculated by Equations (1) to (3).

Figure 4:
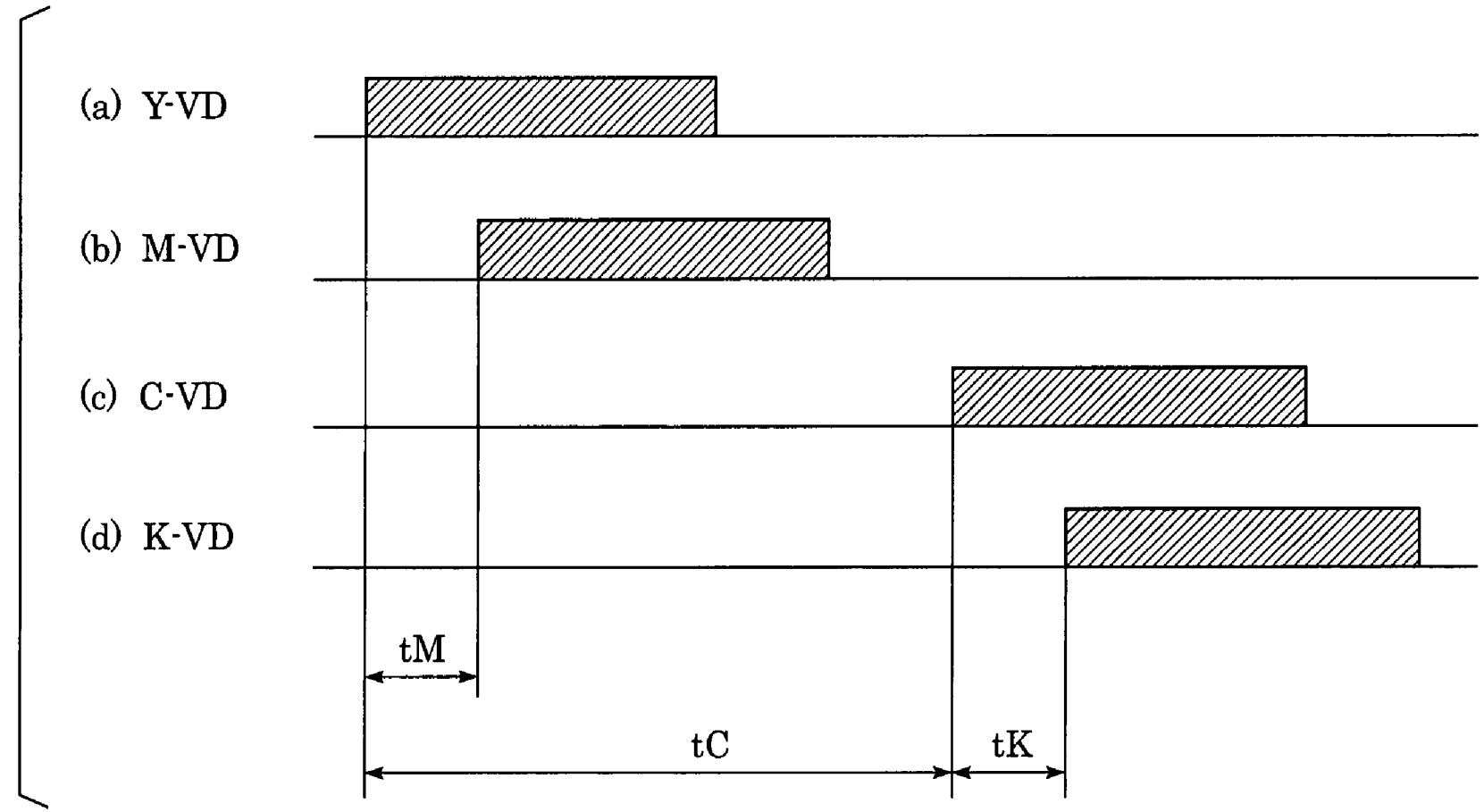
FIG. 4 is a diagram showing timing to start writing images of different colors according to the first embodiment of the present invention.

FIG. 4 is a diagram showing the timing to start writing images of different colors according to the present embodiment. In FIG. 4, (a) Y-VD shows the time to start writing the Y image, (b) M-VD shows the time to start writing the M image, (c) C-VD shows the time to start writing the C image, and (d) K-VD shows the time to start writing the K image. The time to start writing the M image is controlled at tM with respect to the time to start writing the Y image, and the time tM is corrected on the basis of the detection result expressed by Equation (1). The time to start writing the C image is controlled at tC with respect to the time to start writing the Y image, and the time tC is corrected on the basis of the detection result expressed by Equation (2). The time to start writing the K image is controlled at tK with respect to the time to start writing the C image, and the time tK is corrected on the basis of the detection result expressed by Equation (3). The theoretical value of tM is basically the same as that of tK. However, since the developing devices 3 for different colors come into contact with the respective photosensitive drums 1 at different angles between the first and second turns of the intermediate transfer belt 4, the positions of the photosensitive drums 1 are not always the same between the first and second turns. Accordingly, tM and tK may be different from each other.

Second Embodiment

Figure 5:
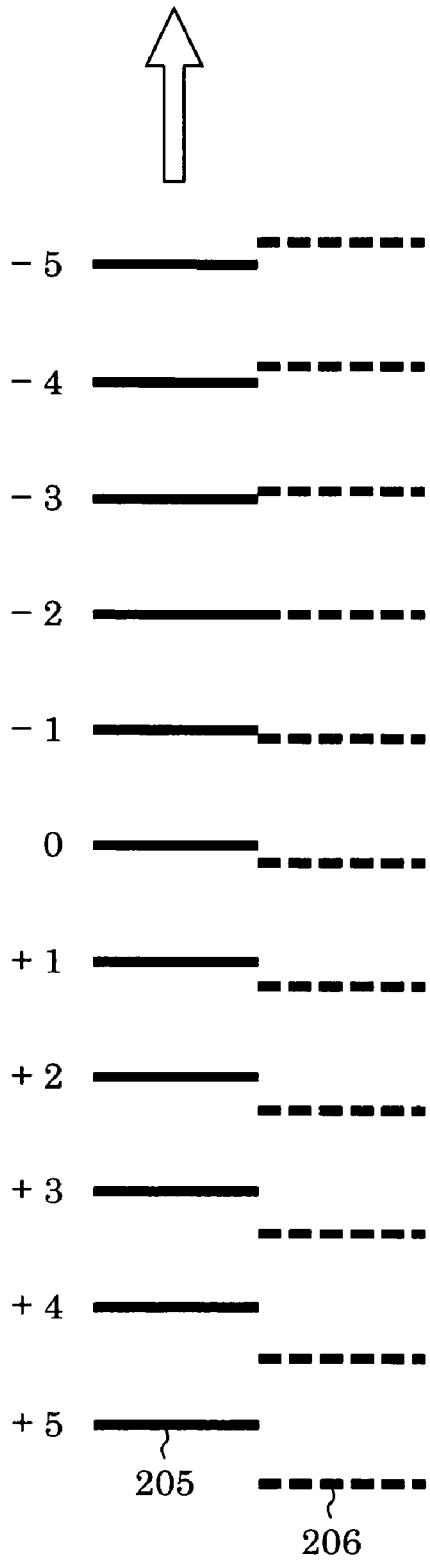
FIG. 5 is a diagram showing a color-shift visual pattern according to a second embodiment of the present invention.

Only differences from the first embodiment will be described. FIG. 5 is a diagram showing a color-shift visual pattern according to a second embodiment. In the second embodiment, the optical sensor 14 shown in FIG. 1 is omitted, and no color-shift detection pattern is formed on the intermediate transfer belt 4. When a user inputs a command to correct color shifts through an operation panel of the printer or the printer driver in the PC, the printer prints a color-shift visual pattern shown in FIG. 5 on a sheet of paper. In FIG. 5, horizontal lines 205 correspond to a reference color and horizontal lines 206 correspond to a detection color. Similar to the first embodiment, color-shift visual patterns corresponding to the combinations of Y and M, Y and C, and C and K are formed on a single sheet of paper. Since the color-shift visual patterns are similar to each other except for the color, FIG. 5 shows only one color-shift visual pattern. The horizontal lines 205 of the reference color are arranged with a constant pitch, and the horizontal lines 206 of the detection color are arranged with a pitch of +5, +4, +3, +2, +1, 0, −1, −2, −3, −4, and −5, along the sheet-conveying direction. The pitch 0 corresponds to the case in which lines of two colors are formed at the theoretical timing with which the lines are to be formed at the same position on the recording sheet. The user observes the color-shift visual pattern shown in FIG. 5 and inputs the number at which the horizontal lines of the reference color and the detection color are formed at the closest positions through the operation panel or the printer driver in the PC. In the case of FIG. 5, −2 is input. Thus, the numbers corresponding to M with respect to Y, C with respect to Y, and K with respect to C are input. The printer corrects the timing to start writing images of different colors on the basis of the input numbers. When, for example, the number is −2 as in the case shown in FIG. 5, the image-forming process is started at the time earlier than the theoretical value by an interval corresponding to two lines in the conveying direction. The user is informed of the process of correcting the timing to start writing the images of different colors based on the color-shift visual patterns through the operation panel or the printer driver in the PC at suitable timing for the printer, so that the color shifts do not increase. For example, the user is informed of the process when the power is turned on, when the photosensitive drums 1 and the developing devices 3 are replaced, when a predetermined number of sheets of paper are processed, etc.

Third Embodiment

Figure 6:
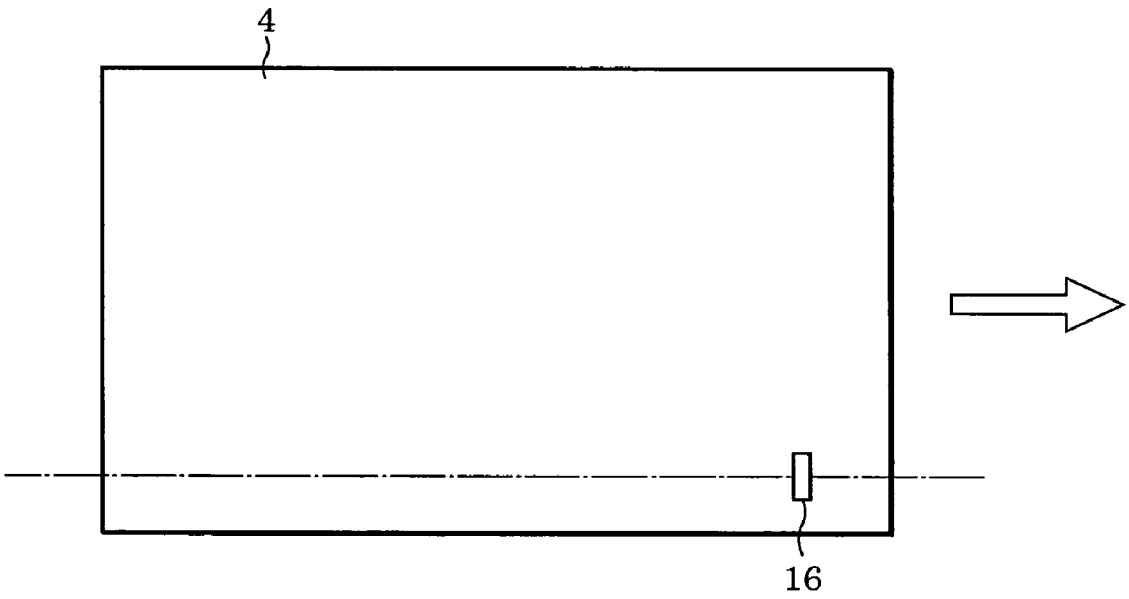
FIG. 6 is a diagram showing a mark on an intermediate transfer belt according to a third embodiment of the present invention.

Only differences from the first and second embodiments will be described. FIG. 6 is a diagram showing a mark 16 on an intermediate transfer belt 4 according to a third embodiment. The mark 16 is formed on the intermediate transfer belt 4 in advance. The mark 16 is formed as a hole or a portion having surface characteristics different from those of the intermediate transfer belt 4 in an image-free region in the scanning direction. With reference to FIG. 1, an optical sensor 15 includes a light emitter section and a light receiver section for detecting the mark 16 on the intermediate transfer belt 4. In FIG. 6, the one-dot chain line shows the detecting position of the optical sensor 15 in the scanning direction.

Figure 7:
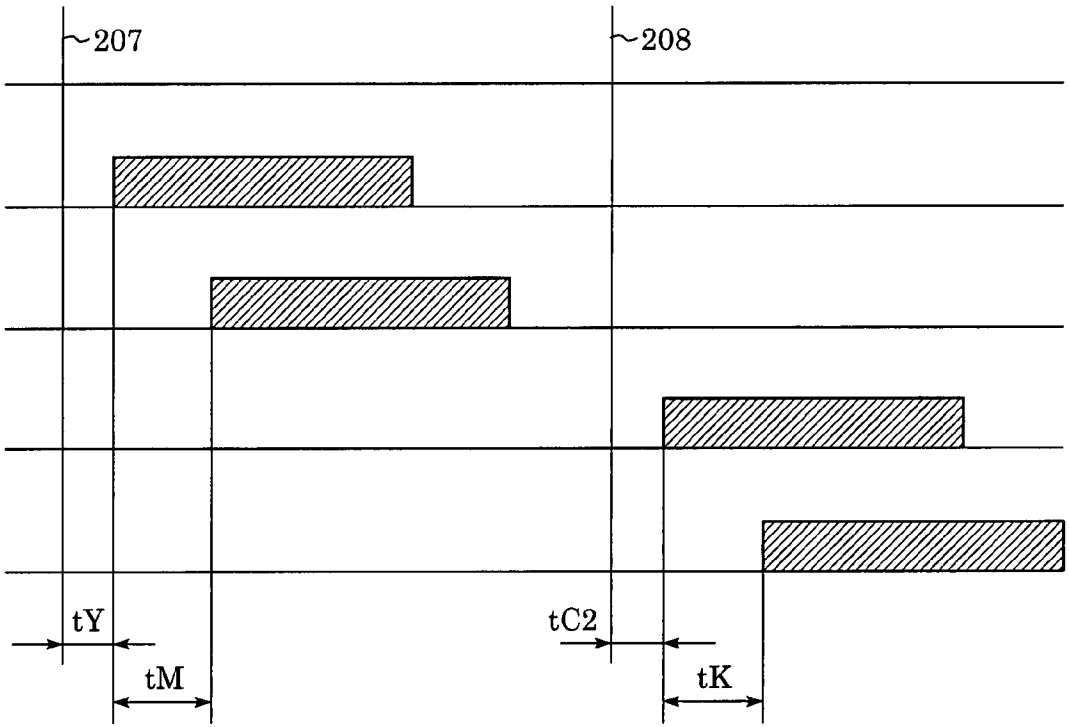
FIG. 7 is a diagram showing timing to start writing images of different colors according to the third embodiment of the present invention.

FIG. 7 is a diagram showing timing to start writing images of different colors according to the present embodiment. In FIG. 7, (e) TOP shows the time at which the mark 16 on the intermediate transfer belt 4 is detected by the optical sensor 15. A TOP signal 207 is obtained in the image-forming process during the first turn of the intermediate transfer belt 4, and a TOP signal 208 is obtained in the image-forming process during the second turn of the intermediate transfer belt 4. In addition, similar to FIG. 4 (first and second embodiments), (a) Y-VD shows the time to start writing the Y image, (b) M-VD shows the time to start writing the M image, (c) C-VD shows the time to start writing the C image, and (d) K-VD shows the time to start writing the K image. Different from FIG. 4 (first and second embodiments), the time to start writing the Y image is controlled at tY with respect to the TOP signal 207, and the time to start writing the C image is controlled at tC2 with respect to the TOP signal 208. The time to start writing the M image and the time to start writing the K image are the same as those in FIG. 4 (first and second embodiments).

A color-shift detecting method according to the present embodiment may be similar to those in FIGS. 3 and 5 (first and second embodiments), and tM and tK are corrected similarly to FIG. 4 (first and second embodiments). With respect to the time at which the C image is formed, tC2 is corrected instead of tC shown in FIG. 4 (first and second embodiments). The time at which the Y image is formed is maintained constant at tY irrespective of the result of color-shift detection. The theoretical value of tY is basically the same as that of tC2. However, since the developing devices 3 for different colors come into contact with the respective photosensitive drums 1 at different angles between the first and second turns of the intermediate transfer belt 4, the relationship between the positions of the photosensitive drums 1 and the detection position of the mark 16 on the intermediate transfer belt 4 is not always the same between the first and second turns. Accordingly, tY and tC2 may be different from each other.

Fourth Embodiment

Figure 8:
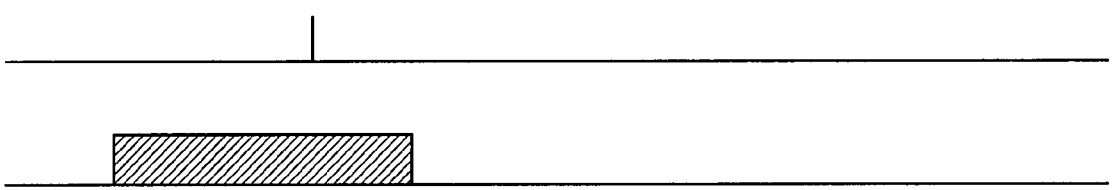
FIG. 8 is a diagram showing timing to start writing a black image according to a fourth embodiment of the present invention.
Figure 9:
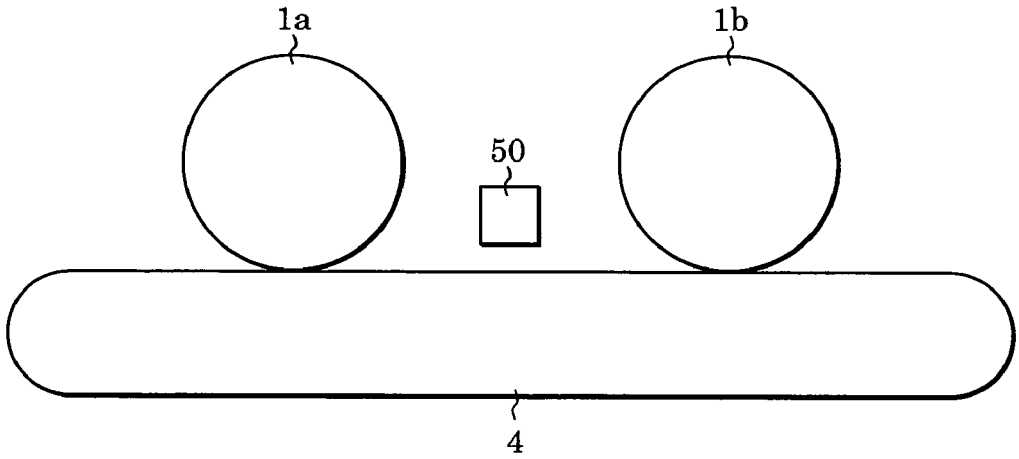
FIG. 9 PRIOR ART
FIG. 9 is a diagram showing a known two-path structure.
Figure 10:
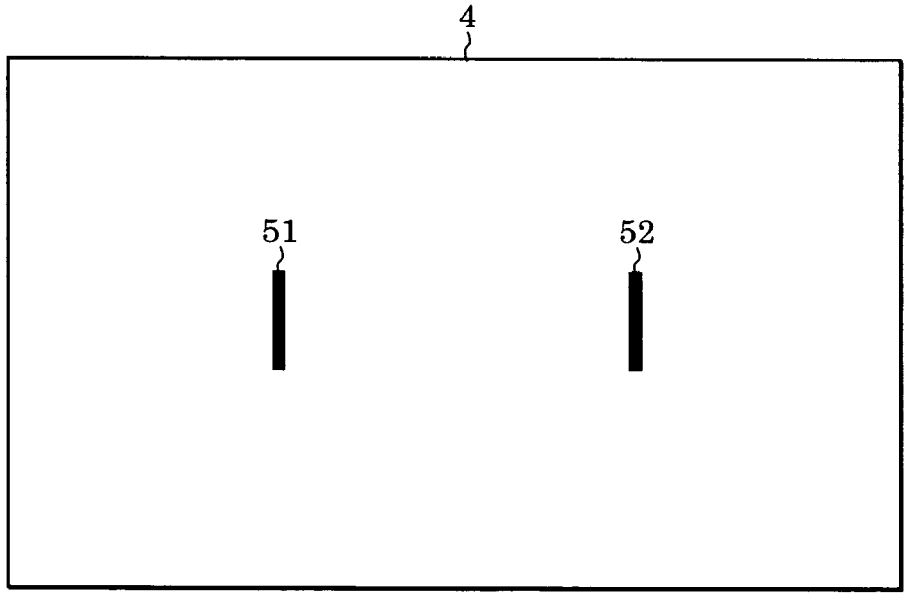
FIG. 10 PRIOR ART
FIG. 10 is a diagram showing a detection pattern on an intermediate transfer belt of a known structure.
Figure 11:
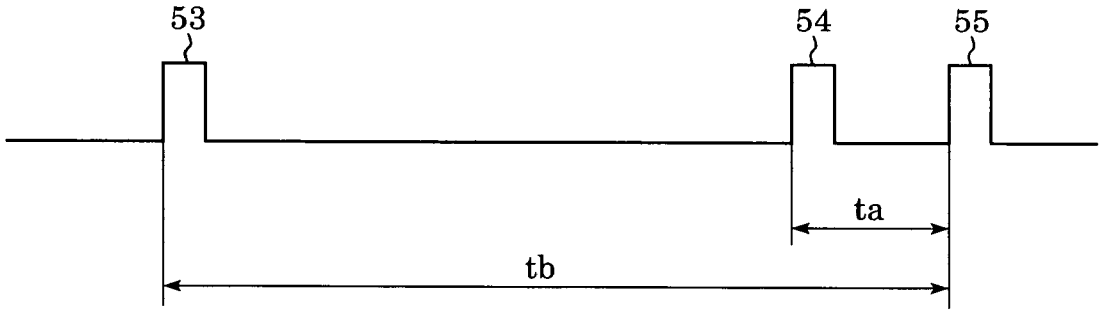
FIG. 11 PRIOR ART
FIG. 11 is a diagram showing detection timing of the detection pattern on the intermediate transfer belt of the known structure.
Figure 12:
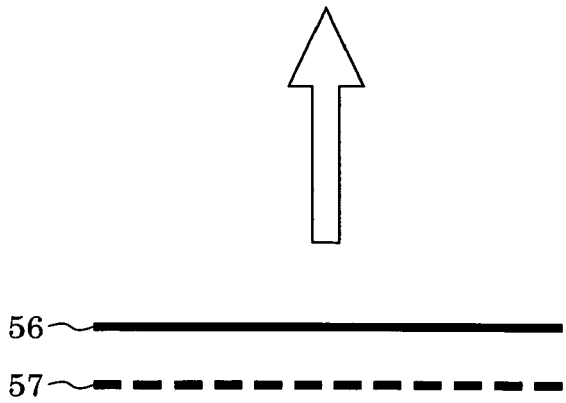
FIG. 12 PRIOR ART
FIG. 12 is a diagram showing an example of a color shift.

Only differences from the first, second, and third embodiments will be described. FIG. 8 is a diagram showing timing to start writing the K image according to a fourth embodiment. In the third embodiment, the timing to start writing images varies depending on the position of the mark 16 on the intermediate transfer belt 4. When the printer is in a state such that the image-forming process can be started, the image-forming process can be immediately started if the mark 16 on the intermediate transfer belt 4 is in front of the optical sensor 15. However, if the mark 16 on the intermediate transfer belt 4 is immediately behind the optical sensor 15, the image-forming process is started after the intermediate transfer belt 4 rotates by substantially one turn. On the other hand, color printers have a monochrome mode which only forms K images. In the monochrome mode, since it is not necessary to form the Y, M, and C images, the image-forming process finishes after a single turn of the intermediate transfer belt 4. In addition, no color shift occurs. Accordingly, in the monochrome mode, as shown in FIG. 8, the time to start the image-forming process ((d) K-VD signal) is set irrespective of the time at which the mark 16 on the intermediate transfer belt 4 is detected ((e) TOP signal).

The two-path structure, the order in which the color images are formed, the color-shift detection patterns, the color-shift visual patterns, the color-shift detecting method, and the color-shift correcting method are not limited to the above-described embodiments.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-171738 filed Jun. 9, 2004, which is hereby incorporated by reference herein.

What is claimed is:

1. A color image-forming apparatus, comprising:

first and second latent-image forming media;

first and second writing units configured to form latent images on the first and second latent-image forming media, respectively, by exposure;

first and second developing devices developing latent images on the first and second latent-image forming media into toner images with first and second colors, respectively;

third and fourth developing devices developing latent images on the first and second latent-image forming media into toner images with third and fourth colors, respectively;

an intermediate transfer device successively passing the first and second latent-image forming media so that toner images developed on the first and second latent-image forming media are successively transferred onto the intermediate transfer device;

a transfer unit transferring a multi-color toner image on the intermediate transfer device onto a recording medium;

a control unit controlling the first and second writing units to form patterns of first, second, third, and fourth colors and controlling timing at which the first and second writing units write on the first and second latent-image forming media, respectively, such that the patterns approach one another;

a correcting unit correcting timing at which the first and second writing units write latent images in response to image data on the basis of positional shifts in the patterns on the intermediate transfer device; and a detecting unit detecting the patterns on the intermediate transfer device, wherein each pattern includes two first lines of the same color and a second line of another color disposed between the two first lines, and wherein the correcting unit corrects the timing on the basis of the detection of the detecting unit.

2. The color image-forming apparatus according to claim 1, wherein the transfer unit transfers the patterns onto a recording medium, and wherein the correcting unit corrects on the basis of information obtained through an input unit which inputs a result of observation of the patterns transferred onto the recording medium.

3. The color image-forming apparatus according to claim 1, further comprising:

the intermediate transfer device including a mark formed thereon; and a sensor detecting the mark, wherein the correcting unit performs the correction on the basis of the positional shifts in the patterns on the intermediate transfer device and detection timing at which the sensor detects the mark.

4. The color image-forming apparatus according to claim 3, wherein the color image-forming apparatus has a monochrome mode, and wherein the correcting unit performs the correction at arbitrary timing irrespective of the detection timing at which the sensor detects the mark in the monochrome mode.

5. The color image-forming apparatus according to claim 1, wherein the first latent-image forming medium is positioned upstream of the second latent-image forming medium with respect to a conveyance direction of the intermediate transfer device, and wherein the correcting unit refers to shifts between patterns formed by the first and second latent-image forming media when the second writing unit writes a latent image on the second latent-image forming medium, and refers to shifts between patterns formed by the first latent-image forming medium in different cycles of rotation of the intermediate transfer device when the first writing unit writes a latent image on the first latent-image forming medium.

* * * * *